United States Patent [19]

Okamoto et al.

[11] Patent Number: 4,566,006

[45] Date of Patent: Jan. 21, 1986

[54] GAS DISCHARGE DISPLAY APPARATUS

[75] Inventors: Yukio Okamoto, Sagamihara; Shinichi Shinada, Kokubunji, both of Japan; Tadao Okabe, deceased, late of Hachioji, Japan, by Kumiko Okabe, administratrix

[73] Assignee: Hitachi, Ltd., Tokyo, Japan

[21] Appl. No.: 495,496

[22] Filed: May 17, 1983

[30] Foreign Application Priority Data

May 17, 1982 [JP] Japan ..... 57-81431

[51] Int. Cl.[4] ..... G09G 3/22; G09G 3/20; G09G 3/00

[52] U.S. Cl. ..... 340/771; 340/753; 340/769; 340/805; 315/111.21; 315/169.4

[58] Field of Search ..... 340/753, 754, 768, 769, 340/770, 771, 773, 792, 805; 315/111.21, 169.4

[56] References Cited

U.S. PATENT DOCUMENTS

| | | | |
|---|---|---|---|
| 3,725,731 | 4/1973 | Kazan | 340/805 X |
| 3,737,707 | 6/1973 | Yanagisawa | 340/771 X |
| 3,775,764 | 11/1973 | Ganz | 340/768 |
| 3,916,393 | 10/1975 | Criscimagna et al. | 340/771 X |
| 3,953,886 | 4/1976 | Ngo | 315/169.4 |
| 3,967,158 | 6/1976 | Saxon | 340/771 X |
| 4,009,414 | 2/1977 | Bockett-Pugh | 340/771 X |
| 4,027,196 | 5/1977 | Criscimagna et al. | 340/771 |
| 4,109,181 | 8/1978 | Murase et al. | 340/805 X |
| 4,127,794 | 11/1978 | Frankland | 340/753 |
| 4,476,466 | 10/1984 | Mitani et al. | 340/805 |
| 4,486,747 | 12/1984 | Okamoto et al. | 340/805 X |

*Primary Examiner*—Marshall M. Curtis
*Assistant Examiner*—Vince Kovalick
*Attorney, Agent, or Firm*—Antonelli, Terry & Wands

[57] ABSTRACT

A gas discharge display apparatus includes a substrate on which a number of electrodes are formed in a row with a distance therebetween and interconnected through polyphase connections. Bipolar pulse voltages are sequentially applied to each phase of the polyphase connections to thereby cause each of the electrodes to operate alternately as an anode and a cathode on a time division basis, whereby discharge produced between the anode and the cathode is caused to perform self-scanning.

22 Claims, 15 Drawing Figures

FIG. 3
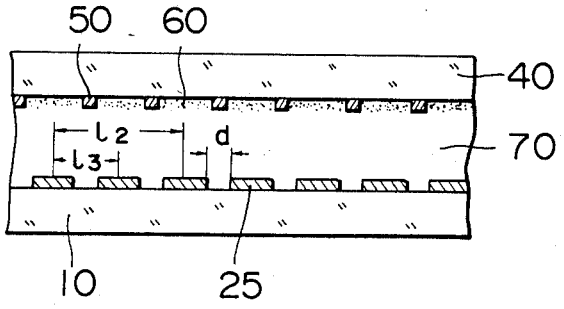
FIG. 4A
FIG. 4B
FIG. 4C
FIG. 4D
FIG. 4E
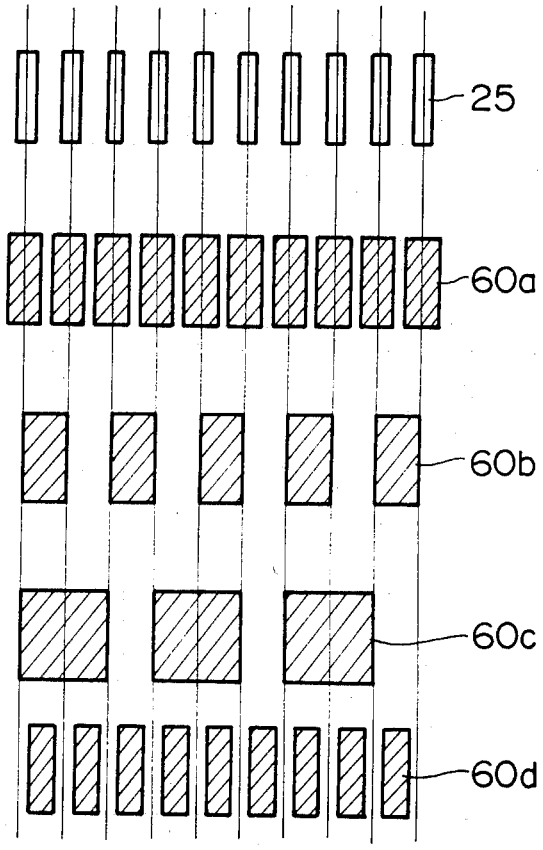

GAS DISCHARGE DISPLAY APPARATUS

The present invention relates to a display apparatus for displaying graphic patterns, characters or the like by making use of gas discharge. In particular, the invention concerns a gas discharge display apparatus of an electronic type which can be advantageously employed in place of hitherto known mechanical moving point (cursor) display devices and enjoy wide applications for measuring instruments and the like.

A bar-graph display apparatus which is a typical one of the gas discharge display apparatus will be briefly described by referring to FIG. 1 together with FIG. 2, in which FIG. 1 is a view showing a cross-section of a display panel and bussing or connections among individual electrodes, while FIG. 2 shows timing diagram for illustrating waveforms of driving voltages. The display apparatus of this type is a prior development in which the present inventors participated and is disclosed in U.S. patent application Ser. No. 311,764, filed Oct. 15, 1981, now U.S. Pat. No. 4,486,747. Referring to FIG. 1, a numeral 10 denotes a substrate on which anode electrodes 20 and cathode electrodes 30 are disposed alternately with each other and bussed, respectively, through two-phase connections 80 and 90 to respective terminals 81; 82 and 91; 92. A face plate 40 is colored in black except for those regions (display elements) 60 which are located in opposition to the cathodes 30, whereby a black matrix pattern 50 is formed. The panel is constituted by the substrate 10 and the face plate 40 which are stacked one above the other with spacers (not shown) being interposed therebetween to thereby constitute a discharge cavity or chamber 70 which is capable of withstanding vacuum of a high degree.

Referring to FIG. 2, two-phase pulse voltages $A\phi_1$ and $A\phi_2$ on one hand and $K\phi_1$ and $K\phi_2$ on the other hand are applied to the anode terminals 81 and 82 and the cathode terminals 91 and 92, respectively. As the pulse voltages are applied on a time-serial base, electric discharge occuring between the anode and the cathode is successively shifted or transferred from the lefthand side to the righthand side as viewed in FIG. 1. When this shift of discharge (referred to as the self-scanning function) is repeated at a certain frequency or period, a bar graph is displayed.

The gas discharge display apparatus mentioned above has advantages as follows:

(1) Because all the electrodes are formed on one and the same plane, the manufacturing process can be simplified and facilitated.

(2) Color display can be readily produced merely by applying phosphor on the display elements 60.

(3) Due to the self-scanning function, the display apparatus can be driven by four driving circuits (terminals) independent of the number of the display elements, whereby reliability of operation can also be improved.

However, the gas discharge display apparatus suffers serious drawbacks mentioned below:

(a) Display with a high resolution (i.e. with a small pitch $l_1$ of the display elements) is impossible because the anodes are formed between the adjacent cathodes to necessarily increase the pitch of the display elements by a sum of the width $l_0$ of the anode and an inter-electrode gap d.

(b) Because of a large size of the display element (i.e. display area) 60, the use life of the display apparatus is shortened due to lowering in gas pressure and/or increase in the discharge current, with uniformity of display being degraded.

It is therefore an object of the present invention to provide a gas discharge display apparatus which is immune to the shortcomings of the prior art display apparatus mentioned above while enjoying the advantages thereof and an elongated use life as well as a high resolution of display, thus finding diverse applications.

In view of the above object, it is proposed according to a general aspect of the present invention that a number of electrodes arrayed in a row on a substrate with a predetermined inter-electrode distance are bussed in polyphase connections or arrangement, wherein bipolar pulse voltages are applied on a time-serial to the terminals of the polyphase connections to thereby cause the electrodes to operate alternately as the anode and the cathode on a time division base.

The above and other objects, features and advantages of the present invention will be apparent from the following detailed description of the preferred embodiments of the invention taken in conjunction with the accompanying drawings, in which:

FIG. 1 is a diagram for showing a structure of a gas discharge display panel disclosed in the above-mentioned U.S. Pat. No. 4,486,747;

FIGS. 3 to 10 are views for illustrating gas discharge display apparatus according to an embodiment of the invention, wherein FIG. 3 is a fragmental sectional view of a display panel employed in the gas discharge display apparatus;

FIGS. 4A to 4E are views showing examples of display patterns;

FIG. 5 is a bussing diagram;

FIG. 6 shows waveforms of driving voltages;

FIG. 7 is a block diagram showing an exemplary arrangement of a driving pulse generating circuit;

FIG. 8 is a circuit diagram showing an exemplary arrangement of a high-voltage pulse generator circuit;

Figure 8:
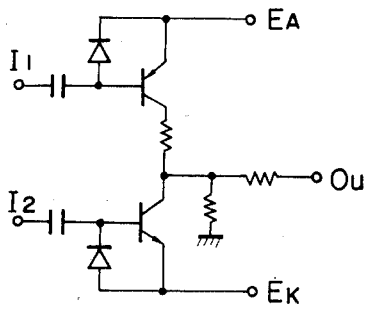
Figure 9:
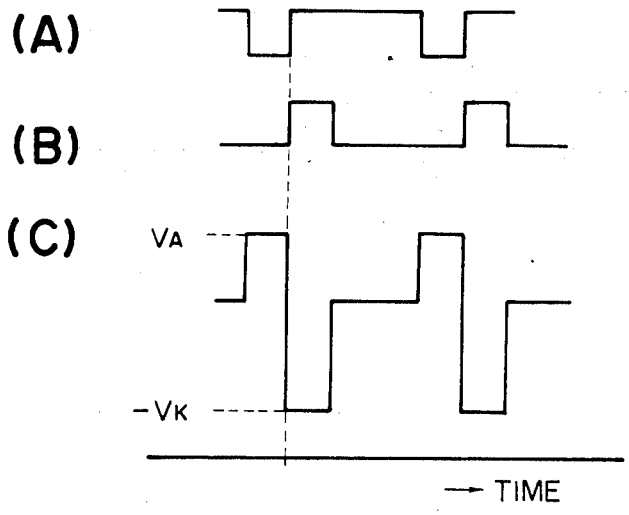
Figure 10:
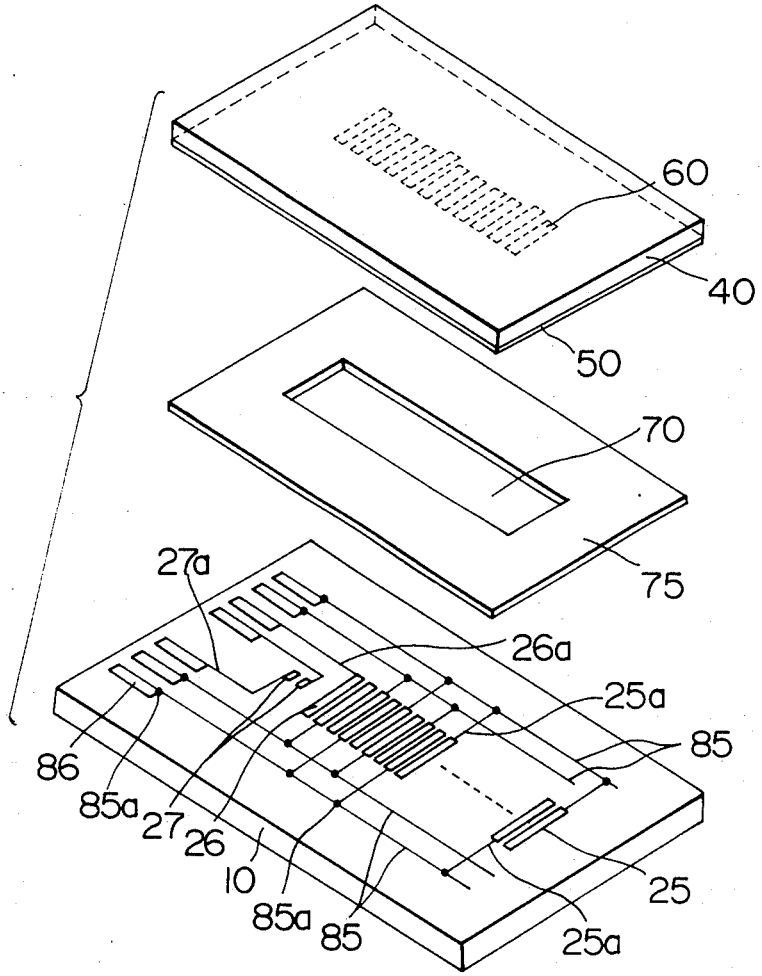

FIGS. 9(A) to 9(C) show waveforms of input and output voltages of the circuit shown in FIG. 8;

FIG. 10 is an exploded perspective view of the display panel; and

Figure 11:
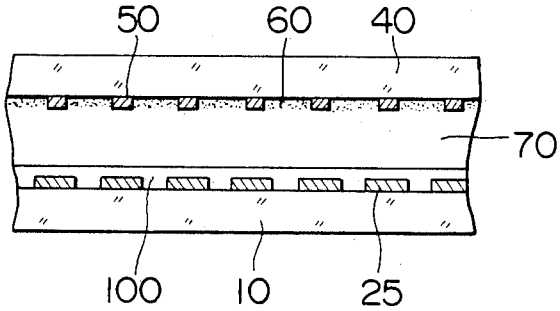

FIG. 11 is a sectional view of a display panel of the gas discharge display apparatus according to another embodiment of the invention.

Now, the invention will be described in detail in conjunction with the preferred embodiments thereof.

Referring to FIG. 3 which shows in a fragmental cross sectional view a display panel employed in the gas discharge display apparatus according to the first embodiment of the invention, a number of electrodes 25 are formed on a substrate 10 with an equidistance $l_3$ therebetween. When the distance $l_2(=2l_3)$ shown in FIG. 3 is selected to be equal to $l_1$ (pitch of the display elements) shown in FIG. 1, i.e. $l_1=l_2=2l_3$, then the pitch of the display elements of the display panel shown in FIG. 3 can be reduced to a half of the corresponding pitch in the display panel shown in FIG. 1 with the result that the density (fineness) of display can be made twice as high, to a great advantage. The distance between any adjacent electrodes is represented by d. With this arrangement, a variety of display patterns such as shown in FIGS. 4B to 4E can be produced for an electrode array pattern shown in FIG. 4A. For example, a display pattern 60*a* including a plurality of pattern elements each corresponding to each of the electrodes 25 may be produced, as is shown in FIG. 4B. In the case of a pattern 60*d* shown in FIG. 4E, each of pattern elements are produced between the adjacent electrodes. Further, combinations of the patterns 60*a* and 60*d* may be produced, as shown in FIGS. 4C and 4D, respectively.

Figure 1:
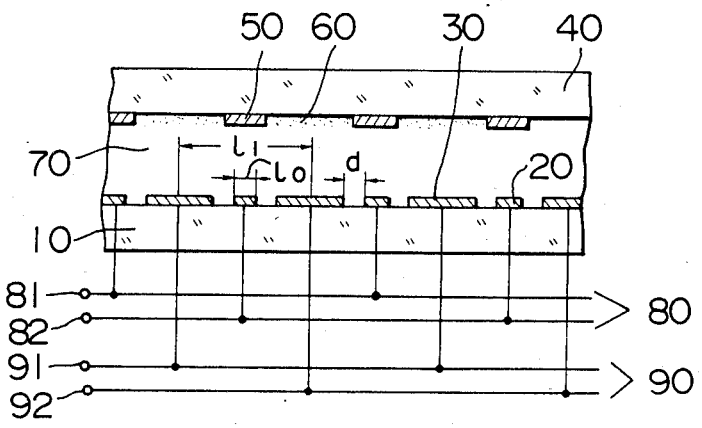
FIG. 1 PRIOR ART
Figure 2:
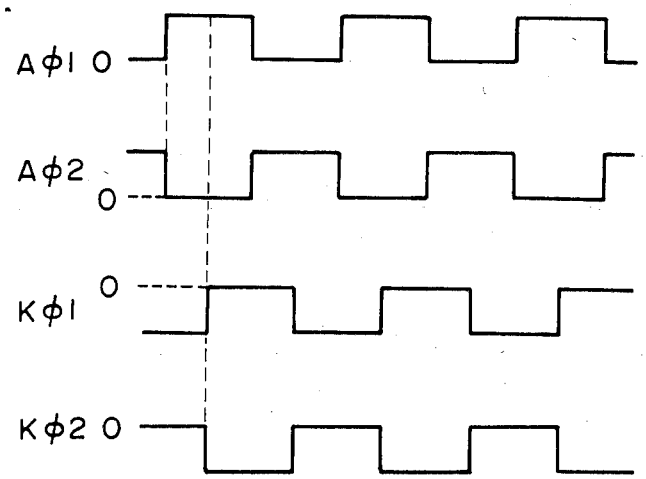
FIG. 2 PRIOR ART
FIG. 2 is a diagram showing waveforms of voltages applied for driving the gas discharge display panel shown in FIG. 1.

In this connection, it should be pointed out that even when the area of display is increased as is the case of the pattern shown in FIG. 4D, uniformity of the display can be nevertheless attained because the pitch of the display elements is decreased to a half of that of the display panel shown in FIG. 1. Further, by virtue of the fact that the effective area of the cathode electrode is significantly decreased as compared with that of the prior art panel, the gas discharge display apparatus according to the illustrated embodiment can be operated at a low current in a high gas-pressure region, since the spreading area of negative glow discharge over the cathode surface is proportional to the discharge current and is in inverse proportion to the square of the gas pressure. Besides, considering the fact that the sputtering rate is proportional to the square or cube of the discharge current and is in inverse proportion to the third or fifth power of the gas presure, degradation in luminance brought about through deposition of the sputtered cathode material onto the phosphor layer can be significantly mitigated to elongate the use life of the gas discharge display apparatus.

Figure 5:
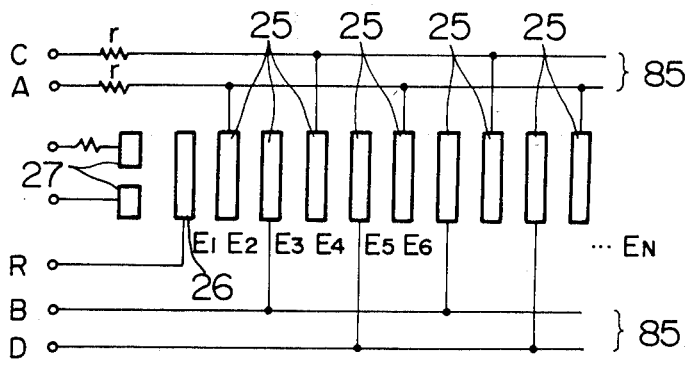
Figure 6:
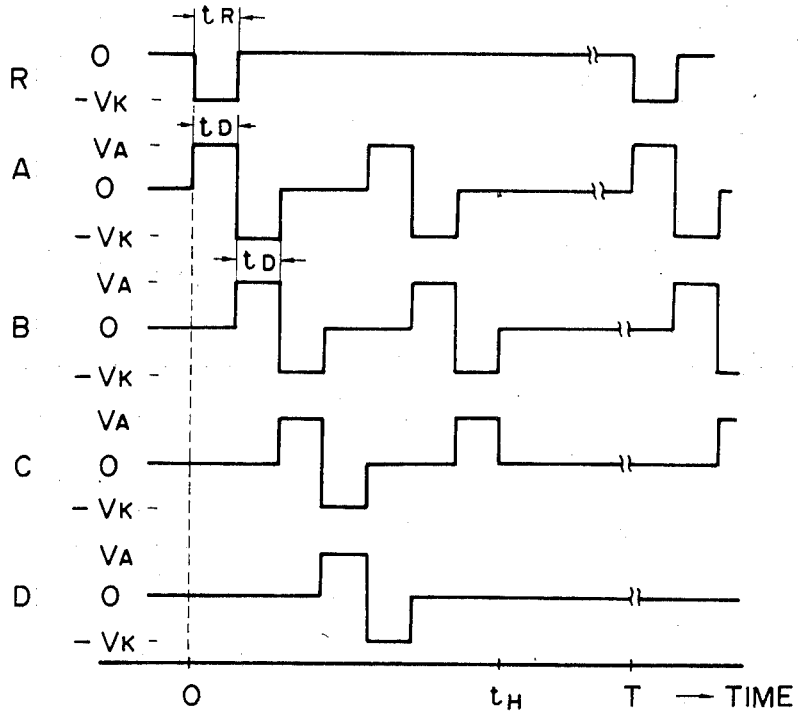

Next, operation of the gas discharge display apparatus will be elucidated by referring to FIGS. 5 and 6, wherein FIG. 5 shows an exemplary disposition and interconnection of the electrodes in the display panel shown in FIG. 3, while FIG. 6 illustrates, by way of example, waveforms and timing of driving voltages applied to the individual terminals of the display panel. In FIG. 6, the waveforms of the voltages are denoted by same reference letters as those attached to the terminals (FIG. 5) to which they are applied, respectively. Referring to FIG. 5, a number of electrodes 25 formed on one and the same plane are bussed in multiphase arrangement, for example, in four-phase arrangement 85 to be connected to the terminals A, B, C and D. Discharge current limiting resistors r are inserted in the even-numbered or odd-numbered phase connections, respectively. Further provided at one end of the electrode array composed of the individual electrodes ($E_2$, $E_3$, . . . , $E_n$) 25 are a reset electrode ($E_1$) 26 connected to the terminal R and a pair of keep-alive electrodes 27.

Bipolar pulse voltages of the waveforms shown in FIG. 6 at A, B, C and D are applied to the associated terminals A, B, C and D on the time serial base with the timing illustrated in FIG. 6. Upon application of the pulse voltage, there occurs at first a reset discharge between the electrodes $E_1$ and $E_2$ which is then successively shifted to the electrodes $E_2$ and $E_3$, $E_3$ and $E_4$, . . . , and $E_{N-1}$. This shift is referred to as the self-scanning function. In the course of the discharge being shifted, the individual electrodes serve alternately as the anode and the cathode. When the polarity of the pulse voltage applied to the reset terminal R is inverted, the polarity of all the other pulse voltages is also inverted. When the period T (FIG. 6) is so selected that flicker is imperceptible (e.g. shorter than 30 ms), it looks in appearance as if all the display elements were simultaneously operating (i.e. emitting light) to produce a bar-like display. The length of the bar (displayed information) can be controlled by controlling the number of pulses (corresponding to $t_H$) at least in the even-numbered phases or odd-numbered phases.

When the gas discharge display apparatus is imparted with the self-scanning function mentioned above, the display apparatus can be operated with the aid of a single reset drive circuit and four drive circuits regardless of the number of the incorporated electrodes (or the number of the display elements). The display apparatus thus can be realized inexpensively with an improved reliability, to great advantages.

Figure 7:
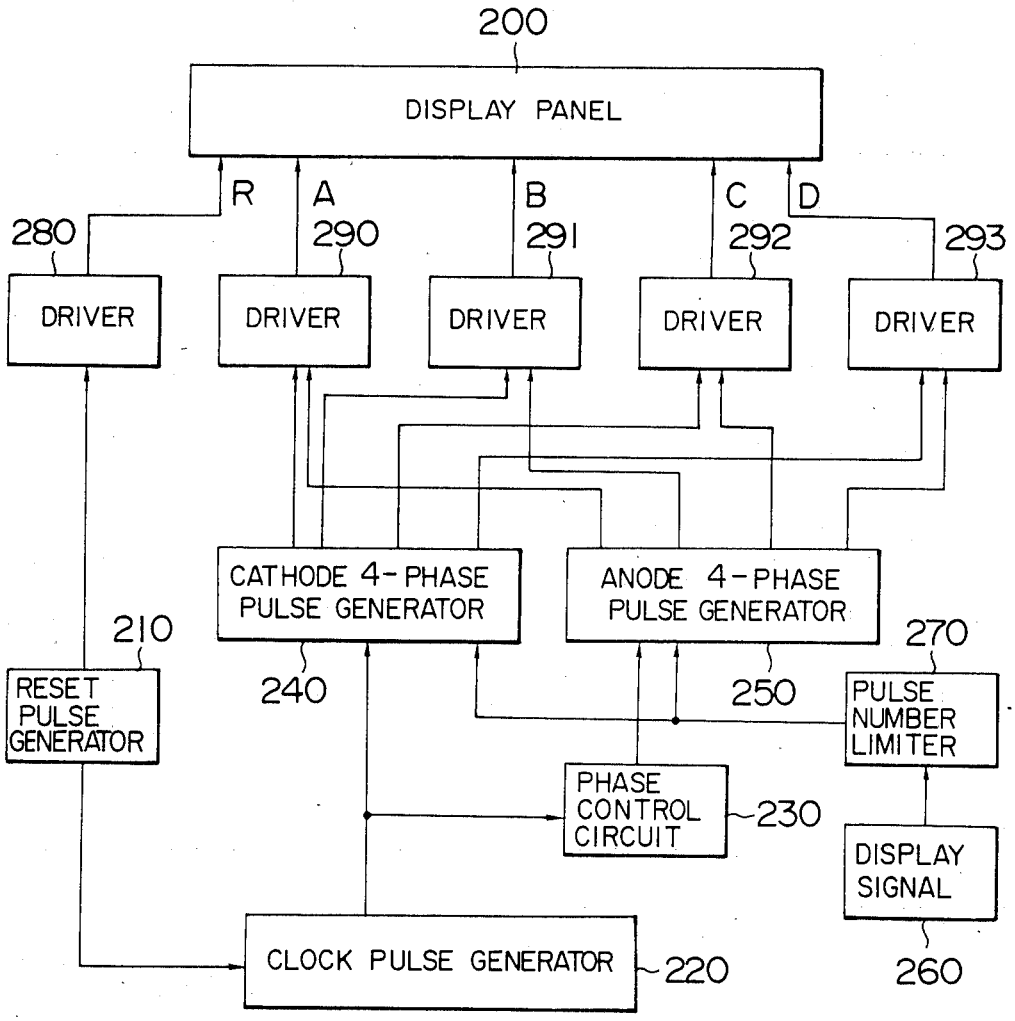

FIG. 7 shows a circuit arrangement for producing the pulse voltages described above. Referring to the figure, a reference numeral 200 denotes the display panel shown in FIG. 3. A reset pulse generator 210 produces the reset pulse shown in FIG. 6 at R. A clock pulse generator 220 produces a clock pulse signal in synchronism with the reset pulse. The four-phase driving pulse signal shown at A, B, C and D, respectively, are derived from the basic clock pulse signal by a cathode 4-phase pulse generator 240 and an anode 4-phase pulse generator 250. At that time, adjustment of phase is effected by a phase control circuit 230 so that difference in phase between the 4-phase pulse signal of negative polarity and the 4-phase pulse signal of positive polarity is $t_D$. The number of the driving pulses is controlled by a pulse number limiter 270 in correspondence with the signal 260 to be displayed. The pulse voltage signals are amplified to an appropriate voltage level through drivers 280, 290, 291, 292 and 293 to be applied to the respective terminals and hence to the electrodes disposed within the display panel 200.

FIG. 8 shows an exemplary circuit arrangement of the driver 290. It should be understood that the other drivers 291, 292 and 293 are also implemented in the same configuration. The 4-phase pulse signals of negative and positive polarities shown in FIG. 9 at (A) and (B), respectively, are applied to input terminals $I_1$ and $I_2$ of the circuit shown in FIG. 8, as the result of which there is produced at an output terminal $O_u$ a bipolar pulse voltage signal of the waveform shown in FIG. 9 at (C) whose amplitude is determined in dependence on the voltages of an anode power supply source $E_A$ (varying from 0 to $V_A$) and a cathode power supply source $E_K$ (varying from 0 to $-V_K$). By setting either the source voltage $E_A$ or $E_K$ at the ground potential, the circuit can be driven with the single power supply source.

FIG. 10 shows in an exploded perspective view an exemplary structure of the display panel shown in FIG. 3. There are formed on an insulation substrate 10 of soda glass or the like the terminals 86, bussing conductors 26*a* and 27*a* for the reset electrode 26 and the keep-alive electrodes 27 and bus bars 25*a* for the electrodes 25 by using gold paste or the like through a printing and firing process. Subsequently, the electrodes 25, the reset electrode 26 and the keep-alive electrodes 27 are formed of Ni-paste or the like through the printing and firing process simultaneously. The number of processes can thus be decreased while the yield being increased. Next, an insulation layer (not shown) is formed of glass paste or the like over the whole surface of the substrate 10 through a printing and firing process except for those areas where the electrodes 25, the terminal 86 and the bus bars 25*a* are to be connected to the polyphase conductors 85 (i.e. at the locations where through-holes are to be formed). The polyphase bussing conductors 85 are formed of gold paste or the like on the insulation layer through a printing and firing process. In this manner, the electrodes 25 are connected to the terminals 86 through the multilayer interconnection. Finally, a thin insulation layer (not shown) is formed of glass paste through a printing and firing process except for the regions where the terminals 86 and the individual electrodes are located.

Disposed on the substrate assembly thus prepared is a spacer member 75 formed of an insulation material such as soda glass or the like for defining the discharge cavity 70. Finally, a face plate 40 formed of a transparent insulation material such as soda glass is disposed on the spacer member 75. The rear surface of the face plate 40 is provided with a black matrix 50 formed of black glass paste through a printing and firing process for the purpose of screening external light rays to thereby enhance contrast of the display. In case the display is to be produced in color, the display elements 60 are applied with appropriate phosphor.

The stacked structure of the substrate 10, the spacer 75 and the face plate 40 is hermetically sealed by using glass frit or the like and, after having been evacuated to a high vacuum, filled with Ne-Ar or He-Xe gas at a pressure of 100 to 500 Torrs. In this connection, a small amount of Hg may be admixed to the filling gas for preventing sputtering.

FIG. 11 shows in a sectional view a display panel according to another embodiment of the invention which is characterized by a dielectric layer 100 formed of glass paste or the like over the number of electrodes 25 through a printing and firing process. A film of MgO or the like may be formed on the dielectric layer 100. With respect to the other details of the structure, the display panel shown in FIG. 11 is similar to the one shown in FIGS. 3 and 10. With the structure shown in FIG. 11, the display panel is imparted with a memory function and capable of producing the display with high luminance.

It will now be appreciated that the display panel according to the present invention can display graphic patterns and the like with a high density (fineness or resolution) by virtue of such arrangement that one and the same electrodes are caused to serve alternately as the anode and the cathode on a time division base. Further, the display elements of a large area can be driven stably and uniformly with a low current, whereby the use life of the display panel can be significantly elongated. Besides, the inventive display panel is featured by other advantageous aspects such as the self-scanning function, display in color and others.

What is claimed is:

1. A gas discharge display apparatus, comprising:

a discharge display panel including a plurality of electrodes formed on a substrate with a predetermined distance therebetween, and connecting means for interconnecting said plurality of electrodes so as to enable polyphase pulse voltages to be applied thereto; and voltage applying means for applying sequentially bipolar polyphase pulse voltages to said electrodes through said connecting means so that each of said electrodes operates alternately as an anode and a cathode on a time division basis in response to said bipolar pulse voltages and discharge produced between electrodes operating as the anode and the cathode is caused to perform self-scanning.

2. A gas discharge display apparatus according to claim 2, further comprising a dielectric material on said plurality of electrodes.

3. A gas discharge display apparatus according to claim 1, wherein said voltage applying means includes first and second polyphase pulse generating means for generating polyphase pulse voltages of opposite polarities which are out of phase with each other by a width of the pulse voltage, and means for superposing said pulse voltages generated by first and second polyphase pulse generating means to form bipolar polyphase pulse voltages and for applying the bipolar pulse voltages to said connecting means.

4. A gas discharge display apparatus according to claim 2, wherein said voltage applying means includes first and second polyphase pulse generating means or generating polyphase pulse voltages of opposite polarities which are out of phase with each other by a width of the pulse voltage, and means for superposing said pulse voltages generated by said first and second polyphase pulse generating means to form bipolar polyphase pulse voltages and for applying the bipolar pulse voltages to said connecting means.

5. A gas discharge display apparatus according to claim 3, further including pulse number controlling means responsive to a signal to be displayed for controlling the number of said polyphase pulse voltages generated in accordance with the signal to be displayed.

6. A gas discharge display apparatus according to claim 4, further including pulse number controlling means responsive to a signal to be displayed for controlling the number of said polyphase pulse voltages generated in accordance with the signal to be displayed.

7. A gas discharge display apparatus comprising: a gas discharge display panel including a pair of first and second insulation substrates at least one of which is transparent, a plurality of electrodes formed on said first substrate with a predetermined distance therebetween, connecting means for interconnecting said plurality of electrodes so as to enable polyphase pulse voltages to be applied thereto, insulation means inserted between said first and second substrates to define a cavity within which discharge produced between said electrodes is confined and a gas filled hermetically in said cavity; and voltage applying means for applying sequentially bipolar polyphase pulse voltages to said electrodes through said connection means so that each of said electrodes operates alternately as an anode and a cathode on a time division basis and discharge produced between electrodes operating as the anode and the cathode is caused to perform self-scanning.

8. A gas discharge display apparatus according to claim 7, further comprising a dielectric material on said plurality of electrodes.

9. A gas discharge display apparatus according to claim 7, wherein said voltage applying means includes first and second polyphase pulse generating means for generating polyphase pulse voltages of opposite polarities which are out of phase with each other by a width of the pulse voltage, and means for superposing said pulse voltages generated by said first and second polyphase pulse generating means to form bipolar polyphase pulse voltages and for applying the bipolar pulse voltages to said connecting means.

10. A gas discharge display apparatus according to claim 8, wherein said voltage applying means includes first and second polyphase pulse generating means for generating polyphase pulse voltages of opposite polarities which are out of phase with each other by a width of the pulse voltage, and means for superposing said pulse voltages generated by said first and second polyphase pulse generating means to form bipolar pulse voltages and for applying the bipolar pulse voltages to said connecting means.

11. A gas discharge display apparatus according to claim 9, further including pulse number controlling means responsive to a signal to be displayed for controlling the number of said polyphase pulse voltages generated in accordance with the signal to be displayed.

12. A gas discharge display apparatus according to claim 10, further including pulse number controlling means responsive to a signal to be displayed for controlling the number of said polyphase pulse voltages generated in accordance with the signal to be displayed.

13. A gas discharge display apparatus according to claim 7, wherein a black color material is provided on a surface of said second substrate facing said first substrate except for regions of the surface which are located in opposition to said plurality of electrodes, respectively.

14. A gas discharge display apparatus according to claim 7, wherein a phosphor is provided on a surface of said second substrate facing said first substrate at regions of the surface which are located in opposition to said plurality of electrodes, respectively.

15. A gas discharge display apparatus comprising:

a gas discharge display panel including a plurality of electrodes formed on a substrate with a predetermined distance therebetween, and connecting means for interconnecting said plurality of electrodes so as to enable polyphase pulses to be applied to said plurality of electrodes; and voltage applying means for applying bipolar polyphase pulses to said plurality of electrodes through said connecting means so that each said plurality of electrodes operates alternately as an anode and a cathode on a time division basis to thereby cause discharge produced between electrodes operating as the anode and the cathode to self-scan said plurality of electrodes.

16. A gas discharge display apparatus according to claim 15, further comprising a layer of dielectric material formed on said plurality of electrodes.

17. A gas discharge display apparatus according to claim 15, wherein said voltage applying means includes:

clock pulse generating means for generating clock pulses;

cathode pulse generating means, connected to said clock pulse generating means, for generating polyphase pulses of negative polarity in synchronism with said clock pulses;

anode pulse generating means, connected to said clock pulse generating means, for generating polyphase pulses of positive polarity having a phase which lags behind the phase of the negative polarity polyphase pulses by a width of the pulses of said negative polarity; and means, connected to said anode and cathode pulse generating means, for superposing said negative polarity polyphase pulses and said positive polarity polyphase pulses with one another and for inverting the polarity of the resultant pulses to generate said bipolar polyphase pulses.

18. A gas discharge display apparatus according to claim 17, wherein said voltage applying means further includes pulse number control means, connected to said anode and cathode pulse generating means, for controlling said anode and cathode pulse generating means so that the number of said positive and negative polarity polyphase pulses generated are controlled in response to a signal to be displayed.

19. A gas discharge display apparatus according to claim 17, wherein said voltage applying means further comprises phase control means, connected between said clock pulse generating means and said anode pulse generating means, for adjusting phase difference between said positive polarity polyphase pulses and said negative polarity polyphase pulses.

20. A gas discharge display apparatus according to claim 15, wherein said substrate includes first and second insulation substrates at least one of which is transparent, said plurality of electrodes being formed on said first insulation substrate with said predetermined distance therebetween, and wherein said gas discharge display panel further includes insulation means provided between said first and second insulation substrates for providing a cavity therebetween in which said discharge is produced, and a gas hermetically filled in said cavity.

21. A gas discharge display apparatus according to claim 20, wherein said second insulation substrate includes a transparent face plate, display elements provided on said face plate at regions located in opposition to said plurality of electrodes, and a black matrix pattern provided on said face plate except for said regions on which said display elements are provided.

22. A gas discharge display apparatus according to claim 21, wherein said display elements are coated with phosphor.

* * * * *